US010607773B2

(12) United States Patent
Kohno et al.

(10) Patent No.: US 10,607,773 B2
(45) Date of Patent: Mar. 31, 2020

(54) POWDER MOLDING APPARATUS AND MANUFACTURE OF RARE EARTH SINTERED MAGNET USING THE APPARATUS

(71) Applicant: Shin-Etsu Chemical Co., Ltd., Tokyo (JP)

(72) Inventors: Osamu Kohno, Echizen (JP); Yoshihiro Umebayashi, Echizen (JP); Ryuji Nakamura, Echizen (JP); Takahiro Hashimoto, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 686 days.

(21) Appl. No.: 15/058,395

(22) Filed: Mar. 2, 2016

(65) Prior Publication Data

US 2016/0260542 A1 Sep. 8, 2016

(30) Foreign Application Priority Data

Mar. 5, 2015 (JP) ..... 2015-043326

(51) Int. Cl.
*H01F 1/03* (2006.01)
*H01F 41/02* (2006.01)
(Continued)

(52) U.S. Cl.
CPC ..... *H01F 41/0266* (2013.01); *C22C 38/002* (2013.01); *C22C 38/005* (2013.01);
(Continued)

(58) Field of Classification Search
CPC .... H01F 41/0266; H01F 1/057; H01F 1/0536; C22C 38/06; C22C 38/10; C22C 38/005;
(Continued)

(56) References Cited

U.S. PATENT DOCUMENTS 4,150,927 A 4/1979 Steingroever
6,355,210 B1 3/2002 Hirabayashi
(Continued)

FOREIGN PATENT DOCUMENTS

CN 1253071 A 5/2000
CN 1314223 A 9/2001
(Continued)

OTHER PUBLICATIONS

Machine Translation of JP2000-197997 (Year: 2000).*
(Continued)

*Primary Examiner* — Haytham Soliman
(74) *Attorney, Agent, or Firm* — Westerman, Hattori, Daniels & Adrian, LLP

(57) ABSTRACT

When a powder material (5) is molded by introducing the material into a cavity (11) between a lower punch (2) and a die (1), compression molding the material between upper and lower punches (3 and 2) into a compact (51) of desired shape, and moving up the lower punch (2) to eject the compact (51), a lubricant is applied to the interior surface of the die (1) by fitting a pad (24) around the lower punch (2) and impregnating the pad with the lubricant. Since the lubricant is applied on every molding operation, molding operation can be continuously carried out.

1 Claim, 8 Drawing Sheets

(51) Int. Cl.

| | |
|---|---|
| ***C22C 38/00*** | (2006.01) |
| ***C22C 38/06*** | (2006.01) |
| ***C22C 38/10*** | (2006.01) |
| ***C22C 38/14*** | (2006.01) |
| ***C22C 38/16*** | (2006.01) |
| ***H01F 1/053*** | (2006.01) |
| ***H01F 1/057*** | (2006.01) |

(52) U.S. Cl.
CPC ..... *C22C 38/06* (2013.01); *C22C 38/10* (2013.01); *C22C 38/14* (2013.01); *C22C 38/16* (2013.01); *H01F 1/057* (2013.01); *H01F 1/0536* (2013.01)

(58) Field of Classification Search
CPC ..... C22C 38/14; C22C 38/002; C22C 38/16; B30B 15/0011; B30B 11/02
USPC ..... 148/103
See application file for complete search history.

(56) References Cited

U.S. PATENT DOCUMENTS

| | | | |
|---|---|---|---|
| 6,423,673 | B1 | 7/2002 | Owens et al. |
| 6,482,349 | B1 | 11/2002 | Kohara et al. |
| 2002/0006347 | A1 | 1/2002 | Tokuhara et al. |
| 2002/0175439 | A1 | 11/2002 | Kohara et al. |
| 2005/0208164 | A1 | 9/2005 | Ugai et al. |
| 2009/0234329 | A1 | 9/2009 | Inamoto et al. |
| 2014/0232034 | A1 | 8/2014 | Kusawake et al. |
| 2015/0287530 | A1 | 10/2015 | Ichigozaki et al. |

FOREIGN PATENT DOCUMENTS

| | | | | | |
|---|---|---|---|---|---|
| CN | 103999175 | A | | 8/2014 | |
| JP | 37-21508 | Y | | 8/1962 | |
| JP | H02-76695 | U | | 6/1990 | |
| JP | 4-214803 | A | | 8/1992 | |
| JP | 9-104902 | A | | 4/1997 | |
| JP | H09-168898 | A | | 6/1997 | |
| JP | 10-008102 | A | | 1/1998 | |
| JP | 2000-197997 | A | | 7/2000 | |
| JP | 2002-86300 | A | | 3/2002 | |
| JP | 2003-25099 | A | | 1/2003 | |
| JP | 2004-106041 | A | | 4/2004 | |
| JP | 2005-502770 | A | | 1/2005 | |
| JP | 2005-277180 | A | | 10/2005 | |
| JP | 2006-142313 | A | | 6/2006 | |
| JP | 2006-187775 | | | 7/2006 | |
| JP | 2007-217511 | A | | 8/2007 | |
| JP | 2008-221340 | A | | 9/2008 | |
| JP | 2012-234871 | A | | 11/2012 | |
| JP | 2013089688 | A | * | 5/2013 | ..... B30B 15/0011 |
| JP | 2013-176583 | A | | 9/2013 | |
| TW | 201430873 | A | | 8/2014 | |
| WO | 201214746 | A1 | | 2/2012 | |

OTHER PUBLICATIONS

Machine translation of JP2013089688 (Year: 2013).*
Office Action dated Feb. 6, 2018, issued in counterpart Japanese Application No. 2015-043326, with English translation (9 pages).
Office Action dated May 8, 2018, issued in counterpart Japanese Application No. 2015-043326, with English machine translation. (8 pages).
Office Action dated Mar. 6, 2019, issued in counterpart TW Application No. 105106726 (7 pages).
Office Action dated Sep. 3, 2019, issued in counterpart JP application No. 2015-43326, English translation. (8 pages).
Office Action dated Dec. 3, 2019, issued in counterpart JP application No. 2015-43326, with English translation (8 pages).

* cited by examiner

POWDER MOLDING APPARATUS AND MANUFACTURE OF RARE EARTH SINTERED MAGNET USING THE APPARATUS

CROSS-REFERENCE TO RELATED APPLICATION

This non-provisional application claims priority under 35 U.S.C. § 119(a) on Patent Application No. 2015-043326 filed in Japan on Mar. 5, 2015, the entire contents of which are hereby incorporated by reference.

TECHNICAL FIELD

This invention relates to a powder molding apparatus and a method for the manufacture of rare earth sintered magnet using the apparatus.

BACKGROUND ART

Because of excellent magnetic properties, rare earth sintered magnets as typified by Nd magnets are now widely used in motors, sensors and other components utilized in hard disk drives, air conditioners, hybrid vehicles and the like.

In general, rare earth sintered magnets are manufactured by the powder metallurgy via the following steps. First, raw materials are blended in accordance with a predetermined composition, melted in an induction melting furnace or the like, and cast into an alloy ingot. The alloy ingot is coarsely crushed by a grinding machine such as a jaw crasher, brown mill or pin mill, or by the hydrogen decrepitation process, and then finely ground by a jet mill or the like into a fine powder with an average particle size of 1 to 10 μm. The powder is pressed into a compact of desired shape in a magnetic field for imparting magnetic anisotropy, followed by sintering and heat treatment.

The in-magnetic-field pressing process involved in the manufacture of rare earth sintered magnets by the general powder metallurgy is a die pressing process comprising the steps of using a mold composed of a die, an upper punch and a lower punch, filling a cavity defined between the die and the lower punch with fine powder, and uniaxially pressing the powder between the upper and lower punches. It is a common practice to apply a lubricant to the interior surface of the die for reducing the friction between the upper and lower punches and the die interior surface and facilitating the release of the compact.

For the lubricant application, the method of spraying the lubricant to the interior surface of the die is generally employed. With this method, the molding operation is interrupted at every molding step or after a predetermined number of molding cycles, to take a time for lubricant applying operation. This means that the lubricant applying operation causes a lowering of productivity. It would be desirable to have a measure capable of efficiently applying the lubricant for thereby improving the productivity of rare earth sintered magnets.

CITATION LIST

Patent Document 1: JP-A H04-214803
Patent Document 2: JP-A H09-104902
Patent Document 3: JP-A 2000-197997
Patent Document 4: JP-A 2003-025099
Patent Document 5: JP-A 2006-187775

DISCLOSURE OF INVENTION

An object of the invention is to provide a powder molding apparatus comprising a die, an upper punch, and a lower punch adapted to relatively move up and down, which is designed so as to efficiently apply a lubricant to a necessary portion during compression molding of powder material, without a lowering of productivity, and a method for the manufacture of rare earth sintered magnet using the apparatus.

In one aspect, the invention provides a powder molding apparatus comprising a die, an upper punch, and a lower punch adapted to relatively move up and down, the die having a through hole surrounded by an interior surface and extending between upper and lower ends, the upper punch having a lower surface, the lower punch having an upper surface, the apparatus being operated by moving the lower punch into the die from below to define a cavity between the upper surface of the lower punch and the interior surface of the die, introducing a powder material into the cavity, moving the upper punch into the die from above to compress the powder material between the upper and lower punches under pressure for thereby molding the powder material into a compact of desired shape, relatively moving up the upper punch until the die is opened at the upper end, relatively moving up the lower punch to eject the compact, and removing the compact from the upper end of the die. According to the invention, the lower punch is provided with a band-like channel around its entire periphery, an applicator or pad made of an elastic material which may be impregnated with a lubricant is fitted in the channel, the lower punch is provided with a lubricant conduit for feeding the lubricant to the pad. With this construction, the lubricant is fed to the pad through the lubricant conduit to impregnate the pad with the lubricant, the lubricant is applied from the pad to the die interior surface as the lower punch is relatively moved up and down in the die during the molding operation, and the lubricant applying operation is repeated whenever the molding operation is repeated.

In a preferred embodiment, the pad is made of a felt, non-woven fabric or sponge which may be impregnated with at least 0.01 g/cm$^2$ of the lubricant.

Preferably the powder molding apparatus further comprises means for applying a magnetic field across the cavity between the upper surface of the lower punch and the interior surface of the die. In a preferred embodiment, the powder material is a rare earth alloy powder, the magnetic field is applied on the rare earth alloy powder for magnetization, dispersion and orientation, and in this state, the compression molding is carried out to form a compact of rare earth alloy.

In a preferred embodiment, while the compact is clamped between the upper and lower punches under a predetermined pressure by compressing the compact by the upper punch and/or the lower punch, the compact is ejected from the die by moving up the upper and lower punches relative to the die. More preferably, the compact is ejected from the die by moving up the upper and lower punches relative to the die while the compact is clamped between the upper and lower punches under a predetermined pressure, and the clamping pressure is increased or decreased during the movement of the upper and lower punches.

In a preferred embodiment, the lubricant is at least one agent selected from the group consisting of stearic acid, zinc stearate, calcium stearate, methyl oleate, capric acid, lauric acid, myristic acid, palmitic acid, arachidic acid, behenic acid, and lignoceric acid, dissolved in a volatile solvent.

In another aspect, the invention provides a method for manufacturing a rare earth sintered magnet comprising the steps of compression molding a rare earth alloy powder into a compact, and heat treating the compact for sintering, the compression molding step using the powder molding apparatus defined above.

Specifically, in the powder molding apparatus of the invention, compression molding of powder material is carried out while the band-like pad fitted around the entire periphery of the lower punch is impregnated with the lubricant. Then the lubricant is applied from the pad to the interior surface of the die on every molding operation or whenever the lower punch is moved up and down in the die. Since the operation to define within the die the cavity to be filled with the powder material and the operation to eject the compact cause the lower punch to move all over a portion of the die interior surface subject to pressing and a portion of the die interior surface along which the upper and lower punches slide, the lubricant can be applied to overall the necessary portion of the die interior surface. In addition, since the pad of elastic material fitted around the periphery of the lower punch slides in constant and tight contact with the die interior surface due to its elasticity, the lubricant is evenly and effectively applied from the pad to the die interior surface. This reduces the friction between the upper and lower punches and the die and facilitates the release of the compact. Effective powder pressing is possible.

ADVANTAGEOUS EFFECTS OF INVENTION

The powder molding apparatus of the invention enables continuous molding of powder material while applying the lubricant at the same time as the molding operation, without interrupting the molding operation. Compression molding of a compact of rare earth alloy or the like is possible at a high efficiency. Using the powder molding apparatus, rare earth sintered magnets can be efficiently manufactured.

DESCRIPTION OF PREFERRED EMBODIMENT

Figure 1:
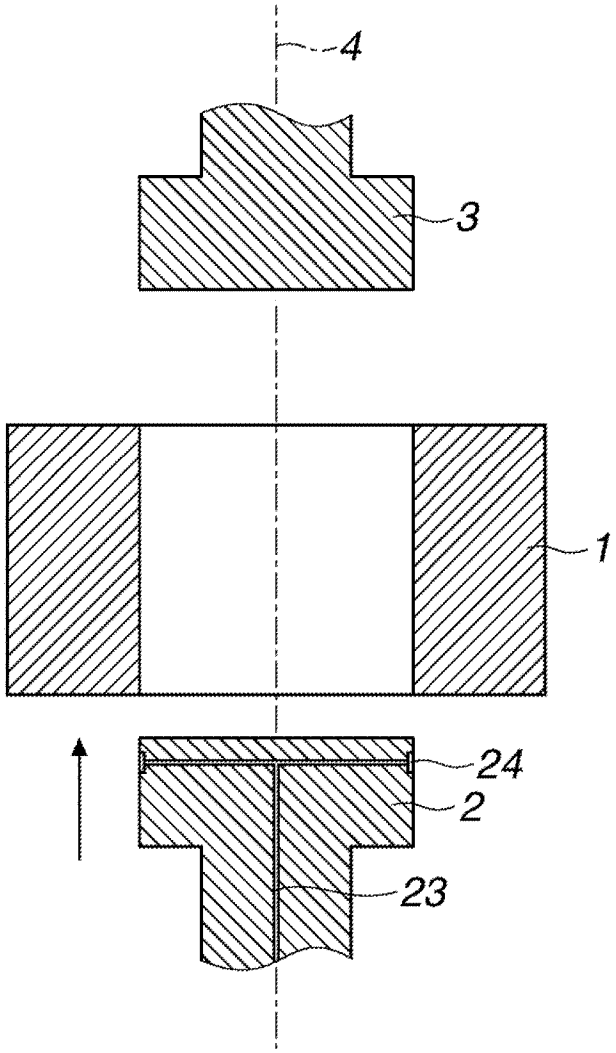
FIG. 1 is a schematic cross-sectional view of a powder molding apparatus including a die, an upper punch and a lower punch according to one embodiment of the invention.

In the following description, like reference characters designate like or corresponding parts throughout the several views shown in the figures. It is also understood that terms such as "top," "bottom," "upper," "lower," and the like are words of convenience and are not to be construed as limiting terms. The term "relative" or "relatively" is used in the sense that either the punch or the die or both may be moved toward and away from each other.

Briefly stated, the powder molding apparatus includes a die, an upper punch, and a lower punch adapted to relatively move up and down. A powder charge is compression molded in the die between the upper and lower punches into a compact of desired shape. The method comprises the steps of compression molding a rare earth alloy powder into a compact using the powder molding apparatus, and heat treating the compact for sintering, thereby yielding a rare earth sintered magnet. One exemplary powder Molding apparatus is illustrated in FIGS. 1 to 7.

FIGS. 1 to 7 illustrate an overall process from the step of compression molding a powder material using the powder molding apparatus in one embodiment to the step of removing the molded compact of powder material. The powder molding apparatus is illustrated in FIG. 1 as comprising a die 1 of rectangular column shape, a lower punch 2 of rectangular block shape adapted to move into the die 1 from below, and an upper punch 3 of rectangular block shape adapted to move into the die 1 from above. As working surfaces, the die 1 has a through hole surrounded by an interior surface and axially extending between upper and lower ends, the upper punch 3 has a lower surface, and the lower punch 2 has an upper surface. They are arranged such that the lower surface of upper punch 3 and the upper surface of lower punch 2 are axially opposed through the through hole of the die 1.

The die 1, lower punch 2 and upper punch 3 are adapted to move up and down relatively along a common axis 4. For example, as the lower punch 2 moves up and/or the die 1 moves down, the lower punch 2 enters the through hole of the die 1 from below and moves to the upper end of the die 1. By relative movement of lower punch 2 and die 1, the lower punch 2 moves up and down within the die 1. Likewise, as the upper punch 3 moves down and/or the die 1 moves up, the upper punch 3 enters the through hole of the die 1 from above. By relative movement of upper punch 3 and die 1, the upper punch 3 moves up and down within the die 1.

Figure 7:
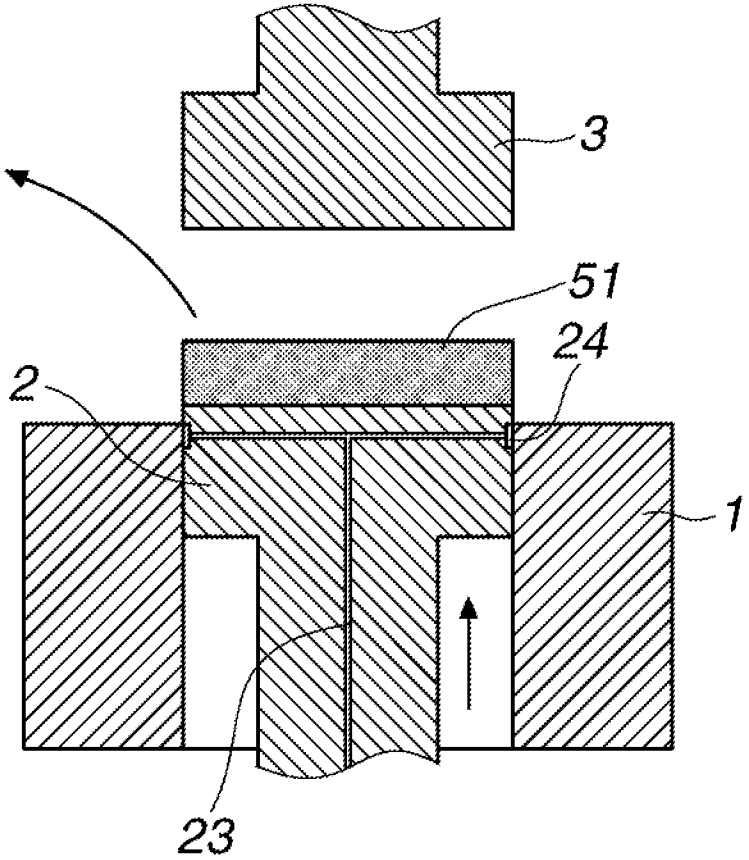
FIG. 7 is a schematic cross-sectional view of the powder molding apparatus in which the lower punch is relatively moved up to eject the compact so that the compact may be removed from the open upper end of the die.
Figure 8:
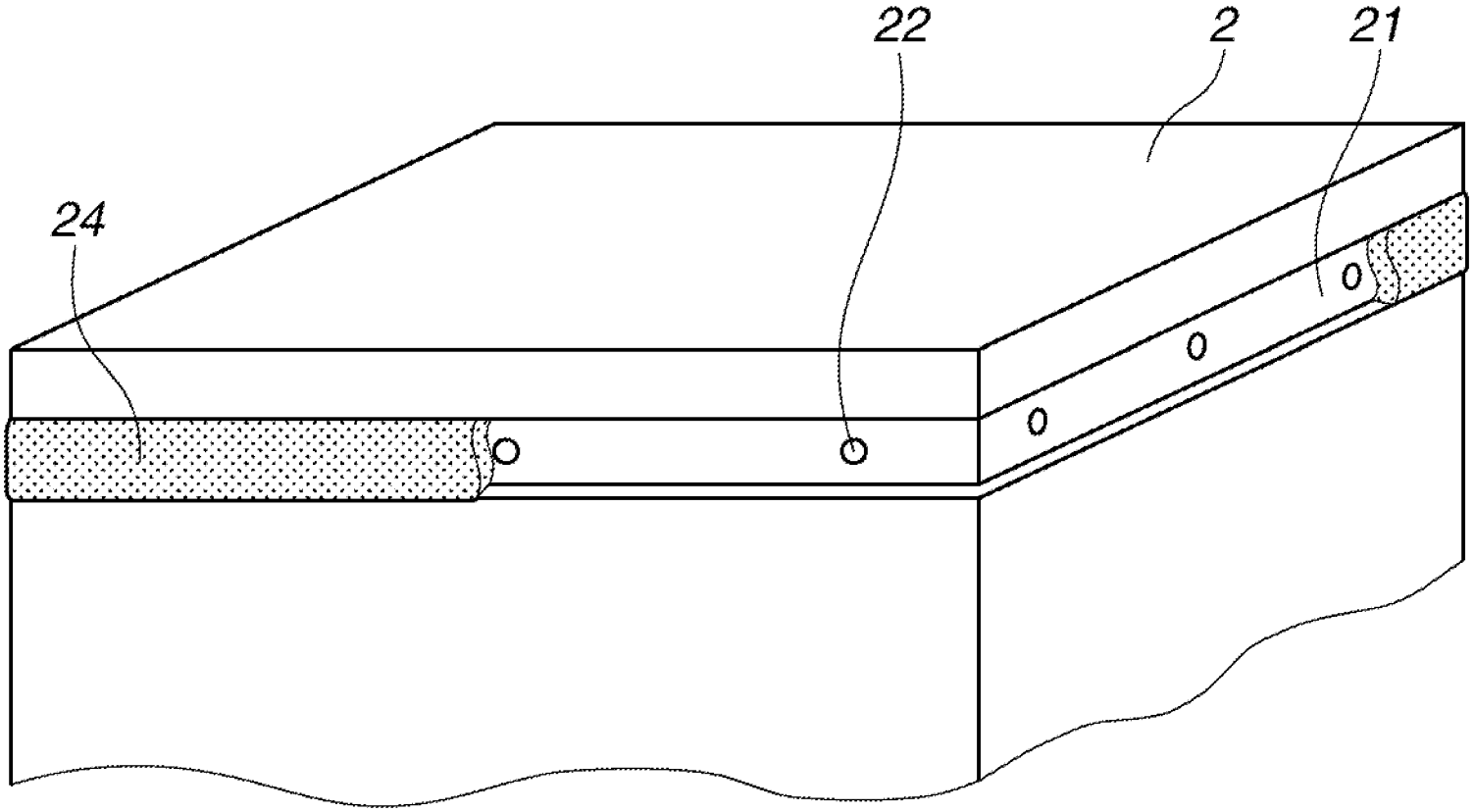
FIG. 8 is a perspective view of the lower punch.

Referring to FIG. 8, the lower punch 2 at its top is provided in the peripheral surface with a rectangular band-like (or loop-like) channel 21. The channel 21 is perforated with a predetermined number (3 ports per side, total 12 ports on four sides) of equi-spaced discharge ports 22 in fluid communication with a lubricant conduit 23 (shown in FIGS. 1 to 7) drilled in the lower punch 2. A lubricant supply (not shown) is actuated to pump a lubricant through the conduit 23 and discharge the lubricant through the ports 22 when necessary.

An applicator pad 24 is fitted in the channel 21. The pad 24 is made of an elastic material which may be impregnated with the lubricant. That is, the pad 24 is impregnated with the lubricant to be discharged through the ports 22. The pad 24 protrudes a distance of about 10 to 1,000 μm from the periphery of the lower punch 2 so that the pad 24 is kept in tight contact with the interior surface of the die 1 under an appropriate pressure when the lower punch 2 moves into the through hole of the die 1. As the lower punch 2 moves up and down relatively within the die 1, the lubricant is automatically discharged from the pad 24 and applied to the interior surface of the die 1.

The pad 24 may be made of any elastic material as long as it may be impregnated with the lubricant. It may be chosen from well-known materials, for example, felt, non-woven fabric and sponge materials. Preferably the elastic material may be impregnated with at least 0.01 g/cm$^2$, more preferably at least 0.04 g/cm$^2$, and even more preferably at least 0.1 g/cm$^2$ of the lubricant although the impregnation amount is not particularly limited. An appropriate impregnation amount may be achieved by adjusting the thickness of the elastic material or the like. If the impregnation amount is less than 0.01 g/cm$^2$, a coating amount sufficient to exert a satisfactory lubricating effect may not be obtained depending on the type of lubricant.

The lubricant used herein is not particularly limited. Any of well-known lubricants used in compression molding of powder may be used. Suitable lubricants include stearic acid, zinc stearate, calcium stearate, methyl oleate, capric acid, lauric acid, myristic acid, palmitic acid, arachidic acid, behenic acid, and lignoceric acid. One or more lubricants are preferably dissolved in a volatile solvent in order to apply the lubricant thinly and evenly. Any appropriate volatile solvent may be selected depending on the type of lubricant. A choice is preferably made among those solvents which evaporate at or below the temperature of 150° C. so that they may evaporate off prior to reaction with the rare earth element during sintering of a compact, for example, fluorocarbons and alcohols having a boiling point in the range of 50 to 150° C.

Figure 2:
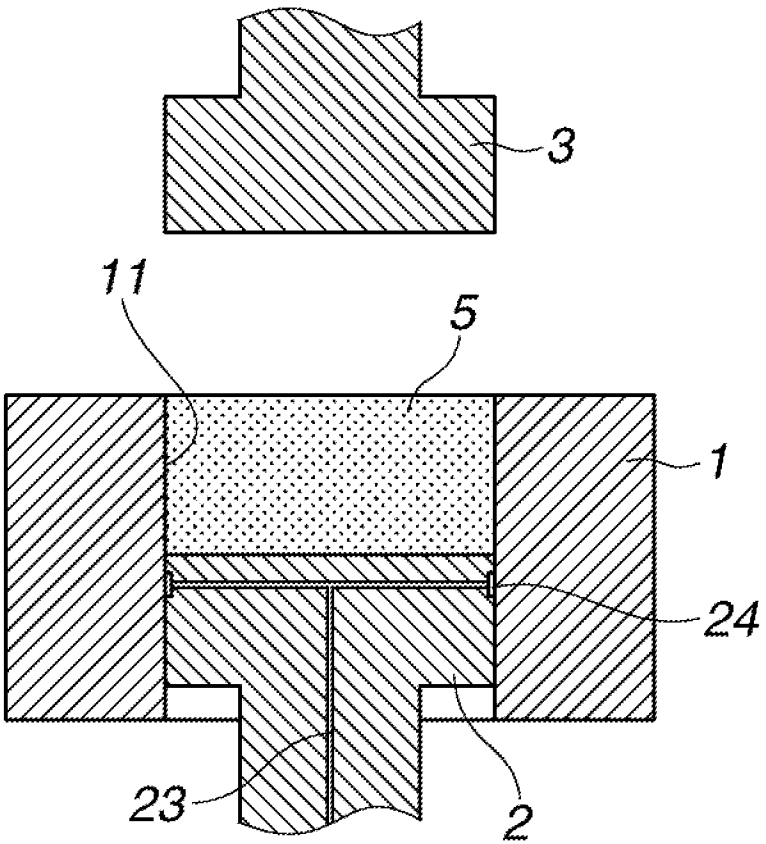
FIG. 2 is a schematic cross-sectional view of the powder molding apparatus in which the cavity defined by the upper surface of the lower punch and the interior surface of the die is filled with powder material.

Using the powder molding apparatus, a powder material such as rare earth alloy powder is compression molded as follows. First, the lower punch 2 is relatively moved up from the state of FIG. 1. The lower punch 2 is inserted into the die 1 from below to define a cavity 11 of predetermined volume between the upper surface of the lower punch 2 and the interior surface of the die 1 as shown in FIG. 2. A powder material 5 is introduced into the cavity 11. At this point, the lower punch 2 is set at an appropriate position to adjust the volume of the cavity 11, and the cavity 11 is filled with the powder material 5 until the material is flush with the upper end of the die 1. Without a need for metering, this ensures that the charge of powder material 5 is always of the predetermined constant volume.

Figure 3:
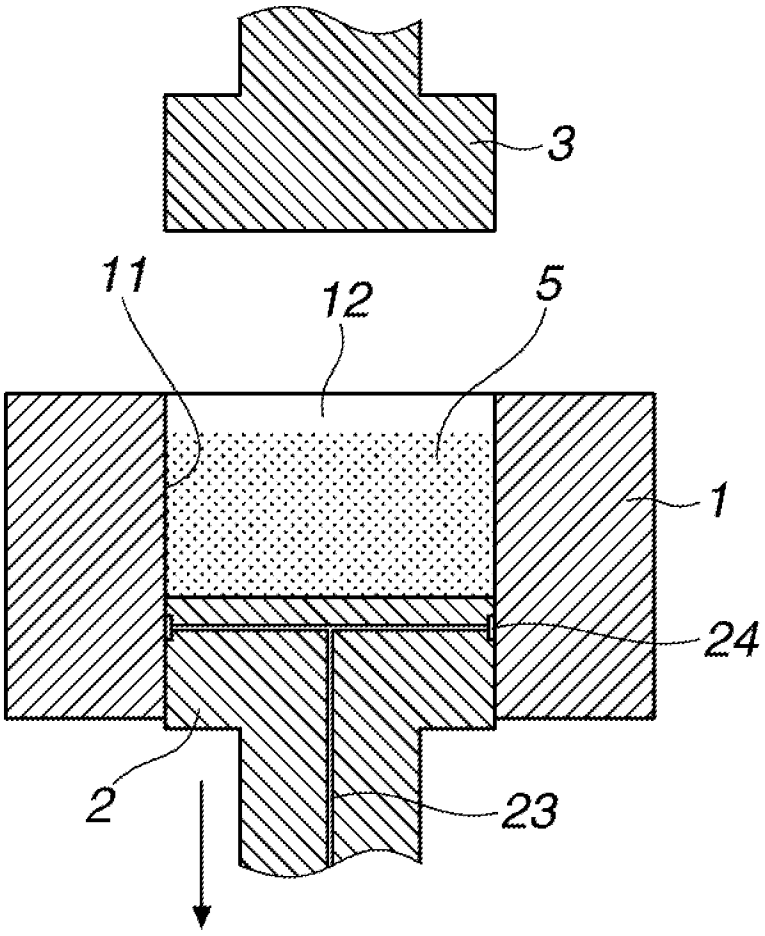
FIG. 3 is a schematic cross-sectional view of the powder molding apparatus in which the lower punch is relatively moved down to define a temporary cavity for allowing the upper punch to rest on the powder material.
Figure 4:
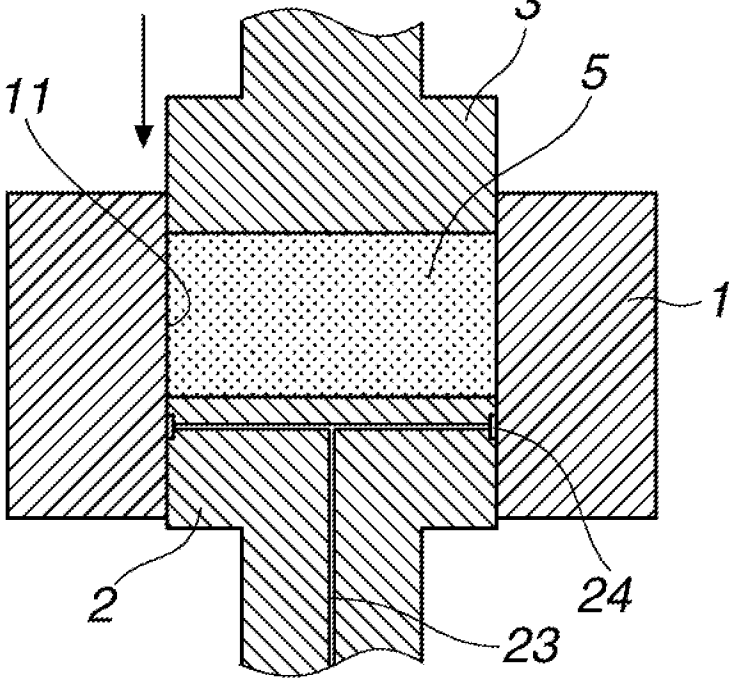
FIG. 4 is a schematic cross-sectional view of the powder molding apparatus in which the upper punch is inserted into the die from above until the upper punch abuts against the powder material.

The sequence from this state is shown in FIGS. 3 and 4. The lower punch 2 is relatively moved down to define above the powder charge 5 a temporary cavity 12 for allowing the upper punch 3 to enter the through hole of the die 1 (FIG. 3). The upper punch 3 is relatively moved down into the temporary cavity 12 to establish the state of FIG. 4 that the upper punch 3 abuts against the top of the powder charge 5. The sequence of once defining the temporary cavity 12 and then moving the upper punch 3 into the die prevents part of the powder charge 5 from overflowing beyond the upper end of the die 1 under the influence of air pressure induced by the advance of the upper punch 3 or the like.

Though not shown, a magnetic field producing means is preferably arranged within or around the die 1, so that a magnetic field may be applied across the powder charge 5 in the die 1. This arrangement ensures that when a rare earth sintered magnet is manufactured using a rare earth alloy powder as the powder material 5, a magnetic field is applied across the rare earth alloy powder 5 in the cavity 11 for magnetization, dispersion and orientation. The rare earth alloy powder which is magnetized, dispersed and oriented under the applied magnetic field is then shaped by compression molding. The resulting rare earth sintered magnet is thus improved in magnetic properties.

Figure 5:
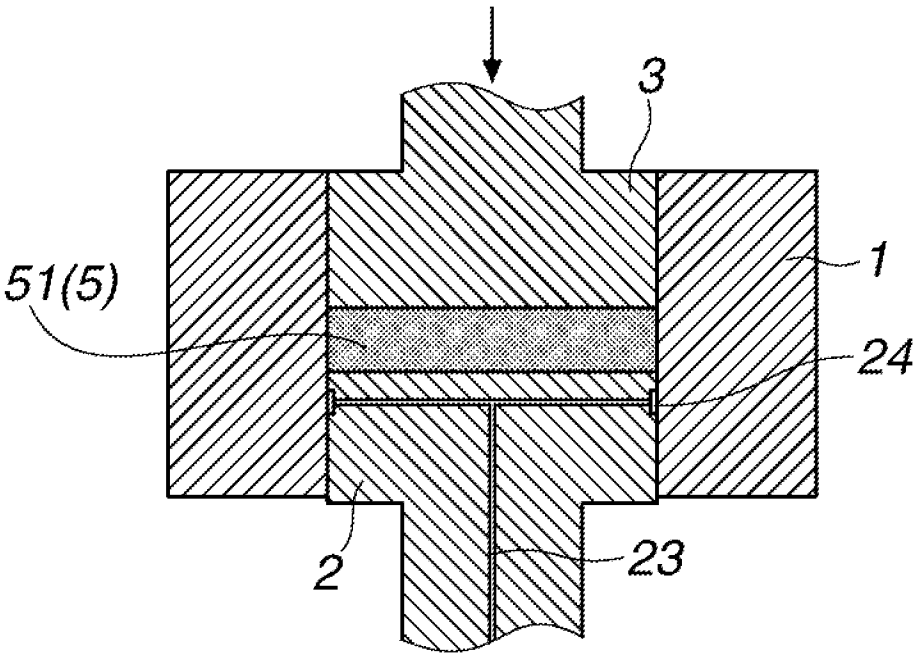
FIG. 5 is a schematic cross-sectional view of the powder molding apparatus in which the powder material in the die is compressed between the upper and lower punches into a compact of desired shape.

Next, as shown in FIG. 5, the lower punch 3 is moved down to compress the powder charge 5 under a predetermined pressure, to form a compact 51 of predetermined shape (typically rectangular block) within the die 1 and between the upper and lower punches 3 and 2. At this point, although the upper punch 3 is moved toward the fixed lower punch 2 to compress the powder charge 5 in FIG. 5, it is acceptable that the lower punch 2 is also moved up to exert a pressure whereby the powder material 5 is compressed by the pressures of both the upper and lower punches 3 and 2.

Figure 6:
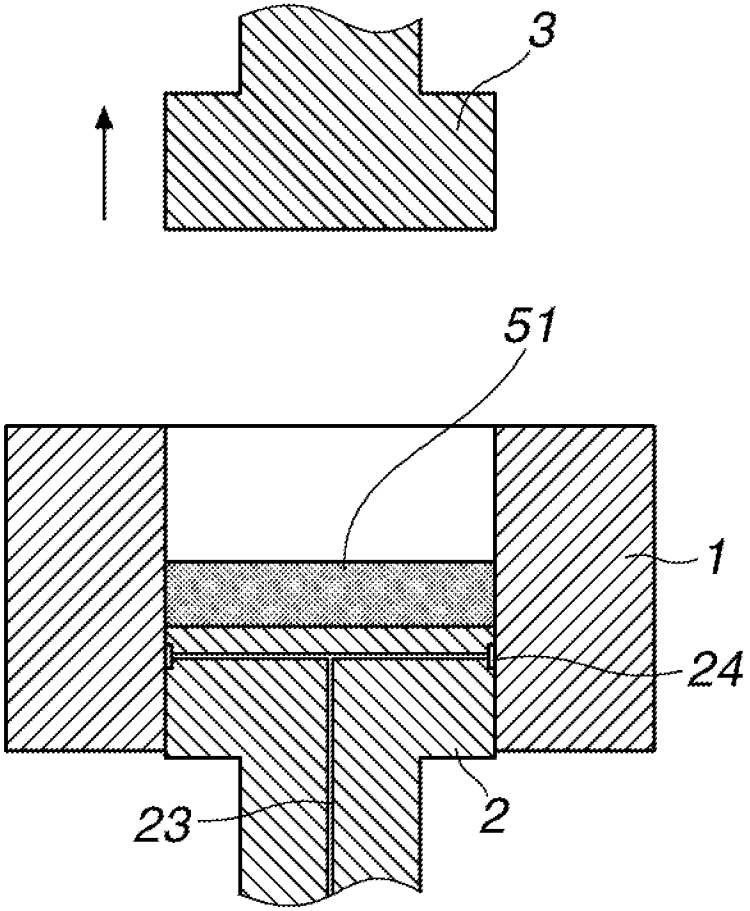
FIG. 6 is a schematic cross-sectional view of the powder molding apparatus in which the upper punch is relatively moved up until the upper end of the die is opened.

After the compact 51 is molded in this way, the sequence is shown in FIGS. 6 and 7. The upper punch 3 is relatively moved up and retracted from the die 1 whereby the upper end of the die 1 is opened (or kept accessible) as shown in FIG. 6. The lower punch 2 is relatively moved up to eject the compact 51 as shown in FIG. 7, and the compact 51 is ejected from the open upper end of the die 1. At this point, although the sequence of moving up the upper punch 3 to make the upper end of the die 1 open, and moving up the lower punch 2 to eject the compact 51 from the upper end of the die 1 is illustrated in FIGS. 6 and 7, it is acceptable that while the upper punch 3 and/or lower punch 2 is forced against the compact 51 under a predetermined pressure, that is, the compact 51 is clamped under a predetermined pressure between the upper and lower punches 3 and 2, the compact 51 is ejected by moving up both the upper and lower punches 3 and 2 relative to the die 1. The ejection of the compact 51 from the die 1, with the compact 51 held under pressure, is effective for preventing the compact from being cracked or chipped during the ejection step.

It is noted that the (clamping) pressure under which the compact 51 is clamped between the upper and lower punches 3 and 2 when the compact 51 is ejected from the die 1 is preferably set lower than the pressure of the molding step. It is acceptable that the pressure of the molding step is once released, and compression is conducted again to set a predetermined pressure. Alternatively, the step of reducing the pressure of the molding step may be interrupted midway at a predetermined intermediate pressure. While the predetermined intermediate pressure is held, the ejection step may be performed. Also the clamping pressure during movement of the upper and lower punches 3 and 2 for ejection may be kept constant, or gradually increased or decreased during movement of the upper and lower punches 3 and 2. The gradual decrease of the clamping pressure during the ejection step is effective for preventing the compact from being cracked or chipped due to an abrupt change of pressure.

After the compact 51 is ejected beyond the upper end of the die 1 (FIG. 7), the compact 51 on the lower punch 2 is removed by any suitable means. Thereafter, the lower punch 2 is relatively moved down, resuming the state of FIG. 1. The die 1, lower punch 2 and upper punch 3 are cleaned if necessary, and the above-mentioned operation is repeated. In this way, the molding of powder material 5 is continuously carried out.

In the powder molding apparatus, a lubricant supply (not shown) is actuated to pump the lubricant through the lubricant conduit 23 to the discharge ports 22 in the lower punch 2 whereby a predetermined amount of the lubricant is discharged from the ports 22 to the pad 24 whereby the pad 24 is impregnated with an appropriate amount of the lubricant. In this state, the molding operation is repeated. In cooperation with the relative up/down movement of the lower punch 2 during the molding operation, the lubricant is discharged out of the pad 24 and applied to the entire interior surface of the die 1. The molding operation is repeated while the die interior surface is effectively covered with a coating of the lubricant at all times. The lubricant coating is effective for reducing the friction between the upper and lower punches 3 and 2 and the interior surface of the die 1 and facilitating the release of the compact. Thus effective powder pressing is possible. When it is desired to manufacture a rare earth sintered magnet using a rare earth alloy powder as the powder material 5, the compact 51 of rare earth alloy powder thus molded is subjected to sintering heat treatment by any conventional method and well-known post-treatment whereby a rare earth sintered magnet is obtained.

The powder molding apparatus of the invention operates to compression mold a powder material while the band-like pad 24 fitted around the outer periphery of the lower punch 2 is always impregnated with the lubricant. As the lower punch 2 is moved up and down within the die 1 on every molding operation, the lubricant in the pad 24 is applied to the interior surface of the die 1. Herein, during the operation in FIGS. 1 to 3 of defining the cavity 11 to be filled with the powder material 5 within the die 1 and the operation in FIGS. 6 and 7 of ejecting the compact 51, the lower punch 2 travels all over a portion of the die interior surface o subject to molding and a portion of the die interior surface where the upper punch 3 slides, ensuring that the lubricant is applied to all the necessary portion of the die interior surface. In addition, due to its elasticity, the pad 24 slides along the die interior surface in tight contact therewith, during which the lubricant in the pad 24 is evenly applied to the die interior surface.

Accordingly, the powder molding apparatus ensures that molding operation assisted by even consistent coating of the lubricant can be continuously carried out without a need to interrupt the molding operation. A compact of rare earth alloy can be compression molded in a highly efficient manner. That is, using the powder molding apparatus, a rare earth sintered magnet can be efficiently manufactured.

Experiments are given below for further illustrating the invention.

EXPERIMENT 1

A Nd base magnet alloy consisting of 25.0 wt % Nd, 7.0 wt % Pr, 1.0 wt % Co, 1.0 wt % B, 0.2 wt % Al, 0.1 wt % Zr, 0.2 wt % Cu, and the balance of Fe was coarsely crushed by hydrogen decrepitation, and finely ground by a jet mill, obtaining a fine powder (rare earth sintered magnet-forming alloy powder) with an average particle size of 3.2 μm. Using the molding apparatus shown in FIGS. 1 to 8, the fine powder was pressed into a compact, which was sintered into a rare earth sintered magnet. The lubricant used herein is a solution of 0.03% stearic acid in a hydrofluoroether solvent (AE3000 by Asahi Glass Co., Ltd.). The pad 24 used herein was 3D non-woven fabric of 1.2 mm thick (Ecsaine® by Toray Industries, Inc., maximum lubricant impregnation amount ~0.11 g/cm$^2$). The molding operation is as follows.

From the state of FIG. 1, the lower punch 2 was relatively moved up and introduced into the die 1 from below to define a cavity 11 between the upper surface of the lower punch 2 and the interior surface of the die 1 as shown in FIG. 2. The cavity 11 was filled with the powder material 5. The amount of the powder material 5 was adjusted such that the powder charge in the cavity 11 might have a density of 1.9 g/cm$^3$.

From this state, as shown in FIG. 3, the lower punch 2 was relatively moved down to define above the powder charge 5 a temporary cavity 12 for allowing the upper punch 3 to move into the die 1. The upper punch 3 was relatively moved down, inserted into the temporary cavity 12 and set at the position where the upper punch 3 abutted against the top of the powder charge 5 (FIG. 4). At this point, the magnetic field producing means (not shown) arranged around the die 1 was actuated to apply a magnetic field of 0.1 T across the powder charge for magnetizing and orienting powder particles. With the applied magnetic field kept so as to prevent the orientation from being disordered, the upper punch 3 was moved down to compress the powder charge 5 under a predetermined pressure until the powder charge reached a density of 3.8 g/cm$^3$, forming the compact 51 as shown in FIG. 5. At this point, since the compact was in the magnetized state, which suggested that the compact was fragile under the action of magnetic suction force during subsequent handling, a weak magnetic field in opposite direction was applied for demagnetization treatment. Thereafter, in sequence as shown in FIGS. 6 and 7, the upper punch 3 was relatively moved up and retracted from the die 1 to open the upper end of the die 1 (FIG. 6). The lower punch 2 was relatively moved up to eject the compact 51. Then the compact 51 was removed from the open upper end of the die 1. The compact 51 thus recovered was sintered at 1,050° C. and heat treated at 500° C. in a standard manner, obtaining a rare earth sintered magnet.

During the above-mentioned sequence of molding operation, the lubricant supply (not shown) was actuated to pump the lubricant through the conduit 23 to the ports 22 in the lower punch 2, thereby discharging a predetermined amount of the lubricant from the ports 22 to the pad 24 whereby the pad 24 was impregnated with an appropriate amount of the lubricant. Then, as the lower punch 2 was moved up and down, the lubricant was applied from the pad 24 to the interior surface of the die 1. Particularly when the lower punch 2 was moved up from FIG. 6 to FIG. 7, the lubricant was applied to the overall portion of the die interior surface subject to molding. The molding operation could be repeated without a need for a special step of applying the lubricant. The molding apparatus was operated all day long excluding quiescent times of inspection necessary for safety confirmation and adjustment of the system. The molding operation was repeated over 30 days. A cycle time, number of passed parts, number of failed parts, and number of mold adjustments were examined. The results are shown in Table 1. The resulting compacts 51 were sintered at 1,050° C. and heat treated at 500° C. in a standard manner, obtaining rare earth sintered magnets.

EXPERIMENT 2

A compact was molded under the same conditions as in Experiment 1 except that the pad 24 was a felt pad of 0.49 mm thick having a maximum lubricant impregnation amount of ~0.04 g/cm$^2$. The compact was similarly sintered and heat treated, obtaining a rare earth sintered magnet. As in Experiment 1, the cycle time, number of pass parts, number of failed parts, and number of mold adjustments were examined during 30 days of molding operation. The results are shown in Table 1.

EXPERIMENT 3

The pad 24 was omitted, and the lubricant was not supplied from the lower punch. Instead, the lubricant was sprayed through a spray nozzle to the interior surface of the die 1 in the state of FIG. 1. The spray nozzle was mounted on a robot so that the spray position might be adjusted. The step of spraying the lubricant took 15 seconds. Otherwise under the same conditions as in Experiment 1, a compact of alloy powder was molded, sintered and heat treated, obtaining a rare earth sintered magnet. As in Experiment 1, the cycle time, number of pass parts, number of failed parts, and number of mold adjustments were recorded during 30 days of molding operation. The results are shown in Table 1.

TABLE 1

| | Cycle time (sec/part) | Number of pass parts (/30 days) | Number of failed parts (/30 days) | Number of mold adjust-ments | Remarks |
|---|---|---|---|---|---|
| Experi-ment 1 | 52 | 47,340 | 14 | 0 | satisfactory molded state continued over 30 days |
| Experi-ment 2 | 52 | 46,315 | 42 | 1 | due to breakage, felt (as pad 24) was replaced once |
| Experi-ment 3 | 67 | 32,588 | 296 | 4 | due to flaws, the die was polished |

In Experiments 1 and 2 wherein the powder material was molded using the molding apparatus and the method of the invention, the cycle time was short, indicating high productivity, and the number of failed parts (occurrence of cracks and chips) was reduced. Since the lubricant was evenly applied by the pad 24, the mold received little or no flaws, and so a lowering of availability by mold polishing operation was prevented. In Experiment 2, the felt pad was once broken because of its thinness, but after replacement, the molding operation could be continued without problems.

Japanese Patent Application No. 2015-043326 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for manufacturing a rare earth sintered magnet comprising the steps of compression molding a rare earth alloy powder into a compact, and heat treating the compact for sintering, the compression molding step using a powder molding apparatus comprising a die, an upper punch, and a lower punch, the die, the upper punch and the lower punch each adapted to move up and down relative to each other, the die having a through hole surrounded by an interior surface and extending between upper and lower ends, the upper punch having a lower surface, the lower punch having an upper surface, wherein the lower punch is provided with a band-like channel around its entire periphery, a pad fitted in the channel made of an elastic material selected from felt, non-woven fabric or sponge and able to be impregnated with at least 0.01 g/cm$^2$ of the lubricant, and a lubricant conduit for feeding the lubricant to the pad, the lubricant is fed to the pad through the lubricant conduit to impregnate the pad with the lubricant and the lubricant is applied from the pad to the die interior surface as the lower punch is moved relative to the die up and down in the die during the molding operation, the compression molding step further comprising:

moving the lower punch into the die from below to define a cavity between the upper surface of the lower punch and the interior surface of the die, and introducing a powder material into the cavity, moving the upper punch into the die from above to compress the powder material between the upper and lower punches under pressure to mold the powder material into a compact of desired shape, and moving the upper punch up relative to the die until the die is opened at the upper end, moving the lower punch up relative to the die to eject the compact and removing the compact from the upper end of the die, wherein the compact is ejected from the die by clamping the compact between the upper and lower punches under a predetermined pressure by compressing the compact using the upper punch and/or the lower punch, and the compact is ejected from the die by moving up the upper and lower punches relative to the die while clamping the compact.

* * * * *